US006349707B1

(12) United States Patent
Neumann et al.

(10) Patent No.: US 6,349,707 B1
(45) Date of Patent: Feb. 26, 2002

(54) METHOD FOR REGENERATING AN ACTIVATED CARBON FILTER LOADED WITH HYDROCARBONS

(75) Inventors: Klaus Neumann, Sinzing-Unteralling; Stefan Schneider, Nonnweiler, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/652,896

(22) Filed: Aug. 31, 2000

(30) Foreign Application Priority Data

Aug. 31, 1999 (DE) ..... 199 41 347

(51) Int. Cl.[7] ..... F02M 33/02
(52) U.S. Cl. ..... 123/520; 123/518; 123/519
(58) Field of Search ..... 123/520, 518, 123/519, 516, 521

(56) References Cited

U.S. PATENT DOCUMENTS 5,072,712 A * 12/1991 Steinbrenner et al. ..... 123/489
5,437,256 A * 8/1995 Wolez et al. ..... 123/519
5,988,151 A * 11/1999 Schneider ..... 123/698
5,992,396 A * 11/1999 Krimmer et al. ..... 123/519

FOREIGN PATENT DOCUMENTS

| | | |
|---|---|---|
| DE | 44 07 475 A1 | 9/1995 |
| DE | 44 35 420 C1 | 1/1996 |
| DE | 197 01 353 C1 | 3/1998 |
| DE | 197 08 937 A1 | 9/1998 |
| DE | 197 39 567 A1 | 3/1999 |

OTHER PUBLICATIONS

"Kraftfahr Technishes Taschenbuch", Bosch, 22. Auflage, p. 5, 476 and 477, is a manual of automotive technology, as mentioned on p. 4 of the specification.

* cited by examiner

*Primary Examiner*—Bibhu Mohanty
(74) *Attorney, Agent, or Firm*—Herbert L. Lerner; Laurence A. Greenberg; Werner H. Stemer

(57) ABSTRACT

In order to regenerate an activated carbon filter which is seated in a tank vent line, during idling of the internal combustion engine the regeneration valve is brought into the maximum open position, and the throttle valve is simultaneously opened slightly. This produces a higher air mass flow in the intake tract of an internal combustion engine, and the proportion of hydrocarbons introduced by the regeneration remains constant. In order to keep the idling speed of the internal combustion engine constant, a torque reserve is built up, for example by adjusting the ignition angle.

6 Claims, 1 Drawing Sheet

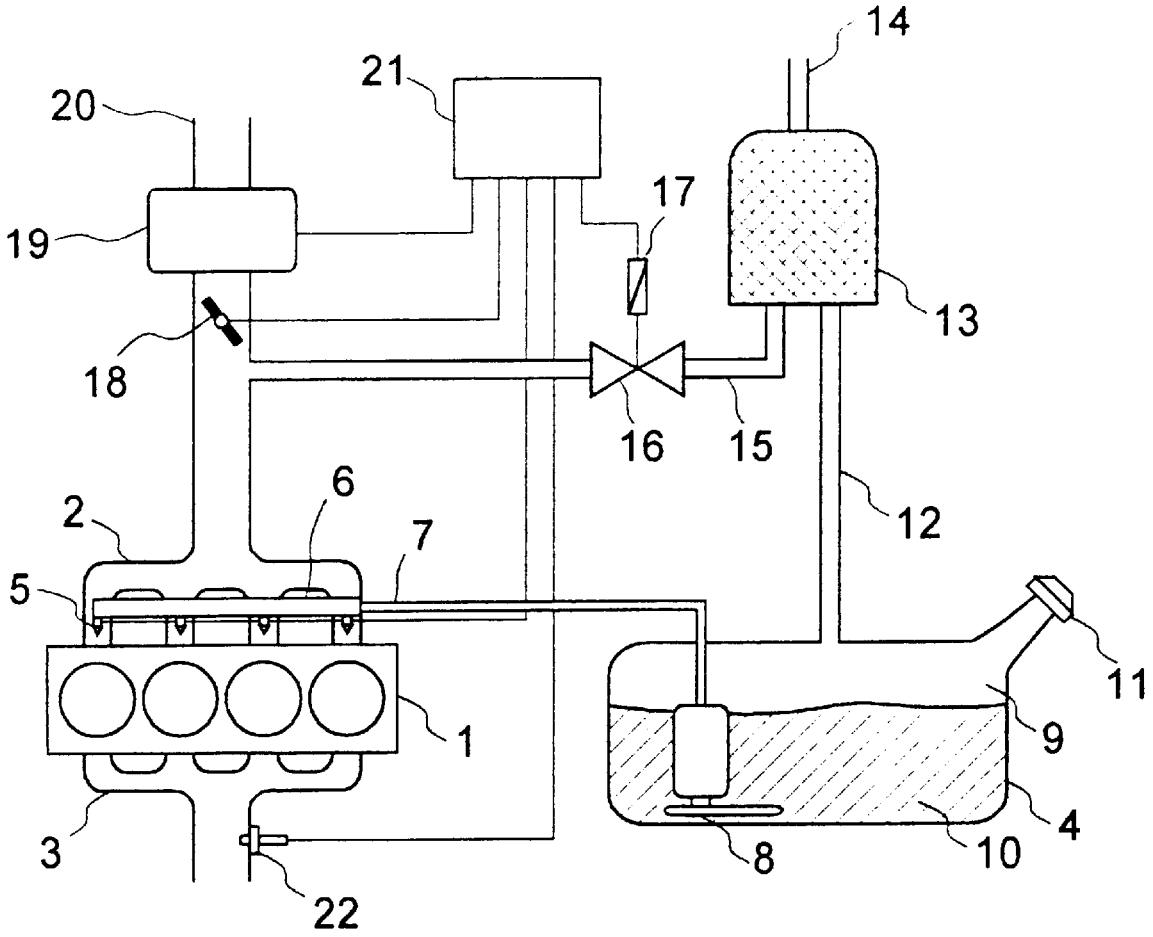
14
21
20
17
19
13
18
16
15
6
2
7
12
5
11
1
9
4
3
8
10
22

METHOD FOR REGENERATING AN ACTIVATED CARBON FILTER LOADED WITH HYDROCARBONS

BACKGROUND OF THE INVENTION

1. Field of the Invention

The invention relates to a method for regenerating an activated carbon filter or carbon canister charged with hydrocarbons.

Because of the vapor pressure, gaseous fuel is constantly also present in the gas tank of a motor vehicle in addition to liquid fuel. Since the tank must have a vent opening for pressure balance, hydrocarbons would constantly escape into the atmosphere by vaporization of fuel. This effect increases with the temperature of the fuel. Such hydrocarbon emissions can be avoided by using activated carbon filters, i.e., carbon canisters, which are connected into the vent line and adsorb vaporized hydrocarbons from the tank. The system is required in order to fulfill the statutory conditions for vaporization losses.

The tank is therefore vented only via an activated carbon filter. Because of the restricted take-up volume of the activated carbon, the activated carbon filter or the activated carbon located therein must be regenerated. For this purpose, while the internal combustion engine is running, air is sucked in from the environment over the activated carbon filter, fed into the intake tract via a regeneration line and fed in this way to the internal combustion engine for combustion. In this process, the underpressure in the intake tract is utilized to aspirate in the air via the regeneration line. In order, in the process, to keep the exhaust emissions within desired limits, and not to have a negative influence on the running properties of the internal combustion engine, the air sucked in through the activated carbon filter and enriched with hydrocarbons must be introduced specifically into the intake tract of the internal combustion engine, and the normally fed fuel quantity must be adapted, for example by an injection correction.

It has become known from commonly assigned U.S. Pat. No. 5,988,151 (German patent DE 197 01 353 C1) to achieve this injection correction by means of the lambda control which is present in any case in an internal combustion engine which is equipped with a 3-way catalytic converter.

For this purpose, a control system drives a regeneration valve which is switched into the regeneration line. By suitably opening the regeneration valve it is possible to adjust the purging flow, which is sucked through the activated carbon filter and introduced into the intake tract. Here, the purging flow is a function of the opening cross section which the regeneration valve uncovers, the pressure difference between the intake tract and environment, and the temperature of the purging flow.

The purging flow is therefore adjusted by suitably driving the regeneration valve with the aid of values supported by a characteristic diagram.

There is a difficulty, in this case, however that this correction of the fuel quantity depends on the mass flow, introduced into the intake tract by the regeneration, of hydrocarbons, which is substantially influenced by the purging flow. It is therefore necessary to know the position of the regeneration valve. Because of this, there is a need for a regeneration valve which can be adjusted very exactly and preferably permits an indication of position.

However, such valves are relatively expensive. Moreover, particularly in the case of small opening cross sections the error between desired and actual values becomes relatively large. For that reason, no generation has yet been possible according to the prior art, for example during idling, in the case of which the regeneration valve would have to be virtually completely closed because of the high underpressure in the intake tract (see, Kraftfahrtechnisches Taschenbuch [Manual of Automotive Technology], 22nd ed., VDI-Verlag, 1995, page 477).

SUMMARY OF THE INVENTION

The object of the invention is to provide a method for regenerating an activated carbon filter charged with hydrocarbons which overcomes the above-noted deficiencies and disadvantages of the prior art devices and methods of this kind, and which satisfies the requirement for precision made of the regeneration valve, and with the aid of which regeneration can be carried out particularly during idling.

With the above and other objects in view there is provided, in accordance with the invention, a method for regenerating an activated carbon filter connected, on one hand, to ambient air and, on the other hand, via an adjustable regeneration valve, to an intake tract of an internal combustion engine, between the internal combustion engine and an adjustable throttle member in the intake tract. The method comprises the following steps, which are performed during an idling of the internal combustion engine:

adjusting the regeneration valve to a setting remote from a minimum opening;

concurrently opening the throttle member from a position assigned to idling, for reducing an underpressure in the intake tract; and building a torque reserve by control intervention on the internal combustion engine, for maintaining an idling speed of the internal combustion engine constant despite the opening of the throttle member.

According to the invention, the regeneration is performed during idling of the internal combustion engine. In this case, the throttle member is opened from the closed position, in order to reduce the underpressure, i.e., the vacuum, in the intake tract. The internal combustion engine simultaneously thereby sucks in a higher air mass flow. Of course, a higher mass flow of hydrocarbons can also be introduced into this air mass flow, for which reason the regeneration valve can be opened further. Consequently, the regeneration valve is in a position remote from the minimum opening, in which even cost-effective regeneration valves are sufficiently accurate. In a preferred refinement of the invention, even a simple two-position valve suffices.

The idling controller builds up a torque reserve in order to prevent the idling speed of the internal combustion engine from rising owing to the opening of the throttle valve. In this case, a torque reserve is understood as a set of measures which act to reduce the torque output by the internal combustion engine, with the overall result that the speed remains constant. A known measure for building up such a torque reserve is, for example, varying the ignition angle.

The time required to regenerate the activated carbon filter is reduced by the increased purging flow through the regeneration valve. Moreover, the fuel quantity can be adapted more exactly through the higher accuracy of the regeneration valve in the larger opening region.

In accordance with an added feature of the invention, the torque reserve is built up with at least one of the following control interventions: adjusting the ignition angle, increasing the exhaust gas recirculation rate, varying the lambda value, and cylinder shutdown.

In accordance with an additional feature of the invention, a loading of the activated carbon filter with hydrocarbons is determined and the loading is expressed in a degree of loading, and the torque reserve is built up in dependence on the degree of loading.

In accordance with another feature of the invention, the regeneration valve is repeatedly opened and closed at a given clock rate.

In accordance with a further feature of the invention, the throttle member is opened ever wider during the regeneration of the activated carbon filter for increasing a purging flow.

In accordance with a concomitant feature of the invention, the regeneration valve is opened ever wider during the regeneration of the activated carbon filter for increasing the purging flow.

Other features which are considered as characteristic for the invention are set forth in the appended claims.

Although the invention is illustrated and described herein as embodied in a method for regenerating an activated carbon filter loaded with hydrocarbons, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawing.

BRIEF DESCRIPTION OF THE DRAWING

The sole figure of the drawing is a schematic block diagram of an internal combustion engine having a tank, an activated carbon filter, and the necessary regeneration devices.

DESCRIPTION OF THE PREFERRED EMBODIMENTS

Referring now to the sole figure of the drawing in detail, there is seen an internal combustion engine 1 which has an intake tract 2 into which fuel is injected via injection valves 5. The injection valves 5 are supplied with fuel from an injection rail 6. Located in the intake tract 2 are a throttle valve 18 and, upstream thereof in a flow direction, an air-mass flow rate meter 19 into which intake air is fed via an intake opening 20.

The injection rail 6 is supplied with fuel via a fuel line 7 which is fed from a pump module 8. The pump module 8 is seated in a tank 4 which can be filled via a stub 11. Liquid fuel 10 is located in the tank 4. Fuel vapor 9 is located in the cavity of the tank 4 above the liquid fuel 10. The tank 4 is, furthermore, connected to the environment via a tank vent line 12 which opens into a vent connection 14, such that pressure balancing can take place.

An activated carbon filter 13, also referred to as a carbon canister 13, is connected in the tank vent line 12. The activated carbon filter 13 contains activated carbon material which adsorbs hydrocarbon. This ensures that no hydrocarbons can be output from the tank vent line 12 at the vent connection 14, since the hydrocarbons are adsorbed in the activated carbon material.

The activated carbon filter 13 is connected via a regeneration line 15 to the intake tract 2 of the internal combustion engine. The regeneration line 15 opens into the intake tract 2 between the internal combustion engine 1 and the throttle valve 18. Switched into the regeneration line 15 is a regeneration valve 16 which is actuated via an actuator 17. This regeneration valve 16 is also called a tank vent valve. A control unit 21 is connected via signal lines to the air-mass flow rate meter 19, the throttle valve 18, the injection valves 5, and the actuator 17 of the regeneration valve 16, as well as to a lambda probe 22 located in the exhaust gas tract 3 of the internal combustion engine 1. The control unit 21 acquires and reads out appropriate measured values via these lines and/or controls the appropriate components.

Fuel vapor is adsorbed in the activated carbon filter 13. In order to prevent hydrocarbons from breaking through to the vent connection 14 when the activated carbon filter 13 is fully charged, the activated carbon filter 13 is regenerated during the operation of the internal combustion engine. For this purpose, a purging flow is generated by the regeneration line 15 and flows from the vent connection 14 into the intake tract 2 through the activated carbon filter 13. In this case, advantage is taken of the underpressure in the intake tract 2, and the purging flow is driven by this underpressure. Since the purging flow through the regeneration line 14 contains hydrocarbons, purging introduces hydrocarbons into the air mass aspirated by the internal combustion engine 1 through the intake tract 2. During the lambda control, the control unit 21 corrects the driving of the injection valves 5 as appropriate, such that the internal combustion engine is nevertheless operated around lambda=1 by means of a correspondingly smaller fuel quantity upon introduction of the purging flow into the intake tract 2.

The control unit 21 continuously monitors the degree of charge of the activated carbon filter 13, for example by model calculations. However, it is also known from U.S. Pat. No. 5,988,151 (DE 197 01 353 C1) to determine the degree of charge from the detuning of the lambda controller. If it is required to regenerate the activated carbon filter 13, the control unit 21 opens the regeneration valve 16 almost completely in an idling phase by means of the actuator 17. At the same time, the throttle valve 18 is open somewhat from the idling position, in which it is almost completely closed. A higher air mass flow into the intake opening 20 is set up thereby and is detected appropriately in the air-mass flow rate meter 19. There are two reasons why it is possible by opening the throttle valve 18 by comparison with the idling position to open the regeneration valve 16 relatively wide, but at least in a region of sufficient positioning accuracy:

a) The underpressure in the intake tract 2 drops downstream of the throttle valve 18. As a result, a smaller purging flow is set up through the regeneration line 15 in the case of a given opening of the regeneration valve 16.

b) Because of the higher air mass flow through the intake tract 2, which is fed to the internal combustion engine 1, it is possible to tolerate a higher purging flow with the higher mass flow of hydrocarbons associated therewith, and the ratio between the mass flow of hydrocarbons and the air mass sucked in remains the same, nevertheless.

The control unit 21 must, of course, ensure that the idling speed of the internal combustion engine 1 remains constant when the throttle valve 18 is opened by comparison with the idling position. This is effected in the case of a torque-based idling controller by building up a torque reserve, for example by adjusting the ignition angle, lambda variation, cylinder shutdown or varying the exhaust gas recirculation rate. It may be noted in this regard that a torque-based idling controller processes a constant torque requirement which is a function of the deviation in speed between the desired and actual speeds such that the desired speed is set by varying torque-influencing operating parameters, taking account of an external torque requirement (for example from a gas pedal position). The torque reserve is therefore a package of measures which acts to reduce torque and would therefore reduce the speed only for itself.

The control unit 21 additionally reduces the fuel quantity output by the injection valves 5 by the following procedure:

The lambda control establishes a deviation in the lambda value in the exhaust gas tract 3 by means of the lambda probe 22 in the exhaust gas tract 3 at the start of the regeneration of the activated carbon filter 13. The control unit 21 now corrects the fuel quantity output by the injection valves 5 such that the lambda probe 22 once again indicates the desired value around lambda=1. If a three-way catalytic converter is provided in the exhaust gas tract 3, injection valves 5 are known in this case to control the mixture such that the signal of the lambda probe 22 executes an oscillation around the value lambda=1.

Since the lambda control is very sensitive, the regeneration is fashioned such that the mass flow of hydrocarbons, which is fed via the regeneration line 15 in the purging flow of the intake air in the intake tract 2, rises in the manner of a ramp. The lambda control can react very sensitively in the case of such a ramp-like rise. By contrast, the problem of an oscillation of the control system would arise in the case of a sudden change in the mass flow of hydrocarbons fed to the intake air. This is compounded by the fact that the purging flow at the start of the regeneration has the highest concentration of hydrocarbons.

The ramp-like change can be effected by two different interventions: on the one hand, the opening of the throttle valve 18 can be fashioned like a ramp, and on the other hand the regeneration valve 16 can be increasingly opened. Of course, it is also possible to combine these two interventions.

For this purpose, the regeneration valve can be repeatedly opened and closed, and the pulse duty factor of opening and closing can be raised. A simple 2-position valve which can be switched only between "open" and "closed" then suffices.

Opening the throttle valve 18 from the idling position prevents the regeneration valve 16 from being permitted to be opened only slightly at the start of the regeneration. The positional accuracy of the regeneration valve 16 for small openings is therefore of no consequence for the regeneration of the activated carbon filter 13.

We claim:

1. A method for regenerating an activated carbon filter, which comprises the following method steps, performed during an idling of the internal combustion engine:

providing an activated carbon filter connected to ambient air and, via an adjustable regeneration valve, to an intake tract of an internal combustion engine, between the internal combustion engine and an adjustable throttle member in the intake tract;

adjusting the regeneration valve to a setting remote from a minimum opening;

concurrently opening the throttle member from a position assigned to idling, for reducing an underpressure in the intake tract; and building a torque reserve by control intervention on the internal combustion engine, for maintaining an idling speed of the internal combustion engine constant despite the opening of the throttle member.

2. The method according to claim 1, wherein the step of building the torque reserve comprises selecting at least one control intervention from the group consisting of adjusting the ignition angle, increasing the exhaust gas recirculation rate, varying the lambda value, and cylinder shutdown.

3. The method according to claim 1, which comprises determining a loading of the activated carbon filter with hydrocarbons and expressing the loading in a degree of loading, and building the torque reserve in dependence on the degree of loading.

4. The method according to claim 1, which comprises repeatedly opening an closing the regeneration valve at a given clock rate.

5. The method according to claim 1, which comprises opening the throttle member ever wider during the regeneration of the activated carbon filter for increasing a purging flow.

6. The method according to claim 1, which comprises opening the regeneration valve ever wider during the regeneration of the activated carbon filter for increasing a purging flow.

* * * * *